US011668178B2

(12) United States Patent
Moberg

(10) Patent No.: US 11,668,178 B2
(45) Date of Patent: Jun. 6, 2023

(54) AUTOMATIC DRILLING HOIST SPEED

(71) Applicant: Caterpillar Global Mining Equipment LLC, Denison, TX (US)

(72) Inventor: Carl John Moberg, Dunlap, IL (US)

(73) Assignee: Caterpillar Global Mining Equipment LLC, Denison, TX (US)

( * ) Notice: Subject to any disclaimer, the term of this patent is extended or adjusted under 35 U.S.C. 154(b) by 0 days.

(21) Appl. No.: 17/026,460

(22) Filed: Sep. 21, 2020

(65) Prior Publication Data

US 2022/0090482 A1 Mar. 24, 2022

(51) Int. Cl.
*E21B 44/02* (2006.01)
*B66D 1/48* (2006.01)
*E21B 15/00* (2006.01)

(52) U.S. Cl.
CPC ..... *E21B 44/02* (2013.01); *B66D 1/485* (2013.01); *E21B 15/00* (2013.01); *B66D 2700/023* (2013.01)

(58) Field of Classification Search
CPC ..... E21B 44/02; E21B 15/00; B66D 1/485; B66D 2200/023
See application file for complete search history.

(56) References Cited

U.S. PATENT DOCUMENTS 5,465,798 A 11/1995 Edlund
9,458,683 B2 * 10/2016 Yorga ..... E21B 19/155
11,091,962 B2 * 8/2021 Haverinen ..... E21B 7/024
2004/0162658 A1 * 8/2004 Newman ..... E21B 19/02 340/685
2014/0083767 A1 3/2014 Mchugh
2014/0144707 A1 * 5/2014 Hartke ..... E21B 15/006 175/57
2014/0343754 A1 * 11/2014 Poettker ..... E21B 44/00 701/2
2017/0234119 A1 * 8/2017 Allen ..... E21B 15/00 700/275
2019/0186212 A1 * 6/2019 Gonzalez ..... E21B 19/084
2019/0268571 A1 * 8/2019 Pettersen ..... G08B 13/19689
2019/0316417 A1 10/2019 Krelifaoui

FOREIGN PATENT DOCUMENTS

CN 102515049 B 5/2014
CN 108505948 A 9/2018
EP 2824273 B1 11/2020
JP 2002256555 A 9/2002

OTHER PUBLICATIONS

Written Opinion and International Search Report for Int'l. Patent Appln. No. PCT/US2021/049582, dated Dec. 20, 2021 (9 pgs).

* cited by examiner

*Primary Examiner* — Taras P Bemko
(74) *Attorney, Agent, or Firm* — Xsensus LLC

(57) ABSTRACT

A method automatically for adjusting the hoist speed of a drill is disclosed. The method includes determining the mast angle of the drilling implement relative to a work surface, and changing the hoisting speed of the drill implement depending on the mast angle.

18 Claims, 6 Drawing Sheets

AUTOMATIC DRILLING HOIST SPEED

TECHNICAL FIELD

The present disclosure relates to machines such as earth moving, mining, construction machines and the like that use a drill to bore blast holes used in a quarry or other mining operation. More specifically, the present disclosure relates to such machines that provide for automatically adjusting the hoist speed of the mast of the drilling apparatus.

BACKGROUND

Machines are routinely used in the earthmoving, construction, mining and other similar industries. Especially in the mining industry, blast holes may be drilled by a rotary drill hole blast rig. Sometimes, the dynamics of the tall drilling mast may provide challenges in maintaining stability during drilling, after drilling, and when hoisting the drill mast. After a hole is drilled, a mound of ground material is typically formed at the opening of the drilled hole created by the removal of the ground material. During the retraction, some of material at the opening of the hole may undesirably fall back into the hole. In addition to previously removed material falling back into the hall, some of the material forming the side of the hole may be dislodged and fall to the bottom of the hole. In either case, this phenomenon is referred to as "fallback". If too much material falls back to the bottom of the drilled hole, explosives placed therein may not work as well as intended or the desired level or plane of subsequent ground material removal operations may not be consistently maintained.

The problem of "fallback" is often exacerbated when drilling a blast hole at an angle relative to the vertical direction. Angled drilling is used in certain applications when vertical drilling is either not practical, or more movement of the blasted material is desired. In particular when angled drilling is performed, there may be excessive fallback when using the standard default automatic drill hoist speed and drill rotation speed on the final retraction of the drill after the desired final hole depth has been achieved.

Various attempts have been made to automatically regulate blast hole drilling in the prior art. For example, Chinese Patent No. CN102515049B discloses a method of ensuring that only vertical drilling is performed. More specifically, after the start of the main hoist being lowered, an angle is detected relative to two orthogonal horizontal axes (such as an X axis and a Y axis). If an angle is detected (greater than zero), the control system of the machine is alerted that the mast is not completely vertically oriented (extends only along the Z axis). Then, the mast is moved until the mast angle is zero, indicating that the mast angle is perpendicular to the horizontal plane.

By adopting this control method, the position of the power head and the position of the first section of the drill pipe are detected in real time, and then the proximity of the upper edge of the first section of the drill pipe to the upper edge of the power head position is compared, thereby judging whether the current main winch will make an easy impact with the ground. If too harsh an impact is suspected due vibration, the hoist speed is lowered, to avoid such a harsh impact and vibration. If a suitable amount of impact and vibration is suspected, then the hoist speed may be kept high.

As can be seen, this prior art does not provide a suitable solution for angled drilling or hoisting, etc.

SUMMARY OF THE DISCLOSURE

A machine according to an embodiment of the present disclosure may comprise a frame, at least two ground engaging propulsion elements coupled to the frame, and a drilling implement including a drill and a mast, defining a longitudinal axis movable relative to the frame and a vertical axis from a vertical position to an inclined position forming a mast angle that is greater than zero degrees measured from the vertical axis to the longitudinal axis in a plane containing the longitudinal axis and the vertical axis. The machine may further comprise a rotary drilling mechanism operatively coupled to the drill, a first monitoring mechanism configured to indicate the mast angle, a second monitoring mechanism configured to indicate a hoisting speed of the hoisting mechanism, a third monitoring mechanism configured to indicate a drill rotation speed, and a control unit coupled to the first monitoring mechanism, the second monitoring mechanism, and the third monitoring mechanism; The control unit may be configured to: determine a maximum hoisting speed of the hoisting mechanism, determine the current hoisting speed of the hoisting mechanism, and command a change to the current hoisting speed of the hoisting mechanism if the current hoisting speed is at the maximum hoisting speed, and if the mast angle is greater than zero; or determine a maximum drill rotation speed of the rotary drilling mechanism, determine the current drill rotation speed of the rotary drilling mechanism, and command a change to the current drill rotation speed if the current drill rotation speed is at the maximum drill rotation speed, and if the mast angle is greater than zero.

An automatic hoist speed adjustment system according to an embodiment of the present disclosure may comprise a first monitoring mechanism configured to indicate a mast angle of a drilling implement including a drill and a mast, a second monitoring mechanism configured to indicate a hoisting speed of a hoisting mechanism, a third monitoring mechanism configured to indicate a drill rotation speed of the drill, and an electronic controller unit coupled to the first monitoring mechanism, the second monitoring mechanism, and the third monitoring mechanism. The electronic controller unit may be structured to: determine a desired hoisting speed, determine a current hoisting speed, and command a change to the current hoisting speed if the current hoisting speed is not the same as the desired hoisting speed; or determine a desired drill rotation speed, determine a current drill rotation speed, and command a change to the current drill rotation speed if the current drill rotation speed is not the same as the desired drill rotation speed.

A method according to an embodiment of the present disclosure may comprise: determining a mast angle of a drilling implement, calculating the desired hoisting speed for a drilling implement based on the mast angle or calculating the desired drill rotation speed based on the mast angle, and hoisting the drilling implement at the desired hoisting speed if desired, or rotating the drill at the desired drill rotation speed if desired.

BRIEF DESCRIPTION OF THE DRAWINGS

The accompanying drawings, which are incorporated in and constitute a part of this specification, illustrate several embodiments of the disclosure and together with the description, serve to explain the principles of the disclosure. In the drawings.

DETAILED DESCRIPTION

Figure 1:
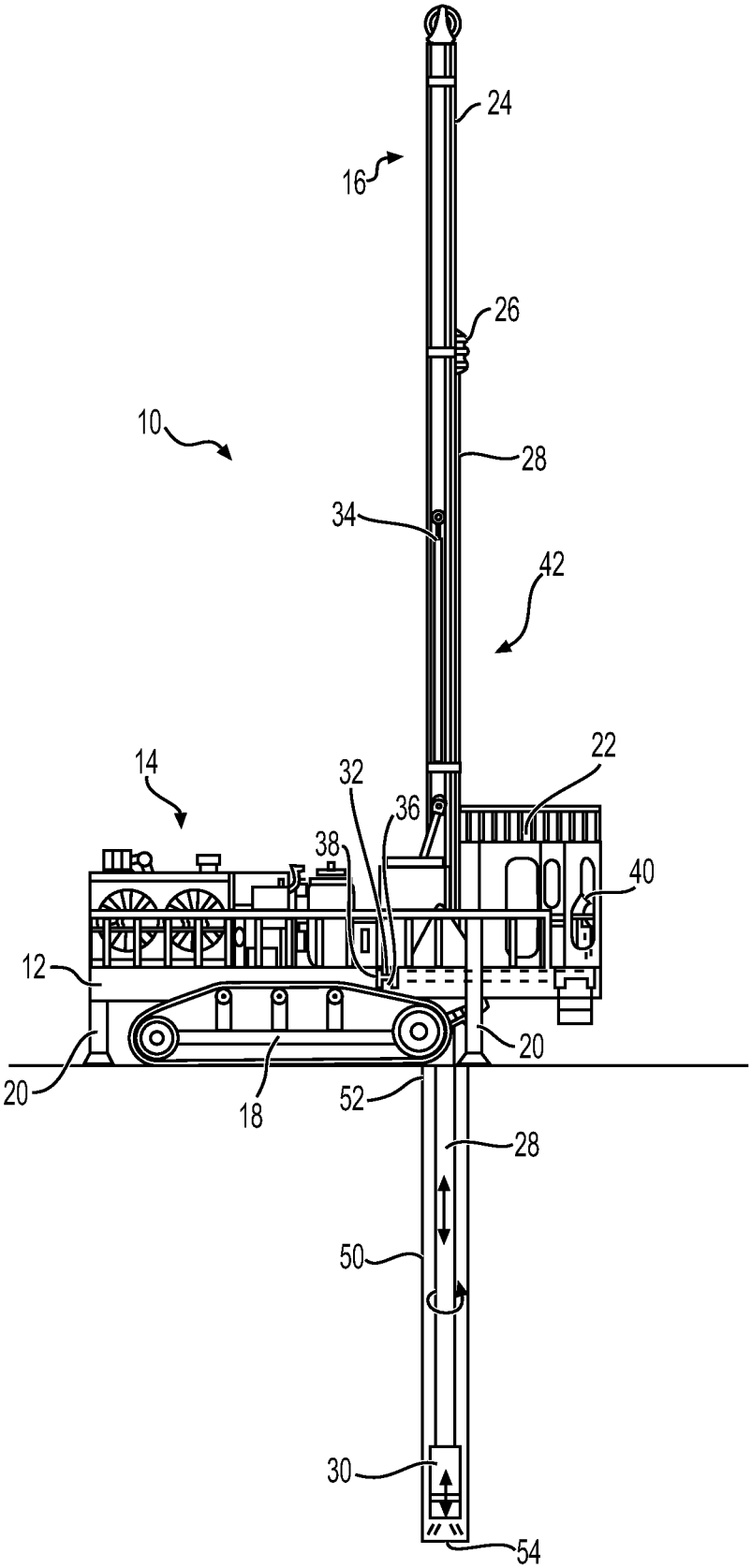
FIG. 1 is a diagrammatic illustration of an exemplary disclosed drill rig.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100a, 100b or by a prime for example, 100', 100" etc. It is to be understood that the use of letters or primes immediately after a reference number indicates that these features are similarly shaped and have similar function as is often the case when geometry is mirrored about a plane of symmetry. For ease of explanation in this specification, letters and primes will often not be included herein but may be shown in the drawings to indicate duplications of features, having similar or identical function or geometry, discussed within this written specification.

In various embodiments, a machine will be described that provides angled drilling with automatic adjustment of hoisting speed and/or drill rotation speed such that excessive fallback may be prevented. In other embodiments, such an automated speed adjustment system will be discussed. Then, a method that may be implemented by or with these embodiments of a machine and an automated speed adjustment system will be explained.

FIG. 1 illustrates a schematic side view of an exemplary drilling machine 10. The disclosure herein may be applicable to any type of drilling machine, however, reference will be made below particularly to a mobile blast hole drilling machine. As shown in FIG. 1, mobile drilling machine 10 may include a frame 12, machinery 14, and a drilling mast 16. Frame 12 may be supported on a ground surface by a transport mechanism, such as crawler tracks 18. Crawler tracks 18 may allow mobile drilling machine 10 to maneuver about the ground surface to a desired location for a drilling operation. Frame 12 may further include one or more jacks 20 for supporting and leveling mobile drilling machine 10 on the ground surface during the drilling operation. Frame 12 may support the machinery 14, which may include engines, motors, batteries, pumps, air compressors, a hydraulic fluid storage tank 36 (shown schematically in FIG. 1) and/or any other equipment necessary to power and operate mobile drilling machine 10. Frame 12 may further support an operator cab 22, from which a user, or operator, may maneuver and control mobile drilling machine 10 via various user interfaces and displays 40.

As further shown in FIG. 1, drilling mast 16 may include a mast frame 24 which may support a drill motor assembly, or rotary head 26, movably mounted on the mast frame 24. Rotary head 26 may couple to, and may be controllable to rotate, a drill string 28 of drilling pipe segments on which a down-the-hole hammer-type drill bit 30 may be mounted for down-the-hole drilling into the ground surface, as further described below. Rotary head 26 may be any type of rotary head, such as a hydraulic rotary head or the like. Rotary head 26 may further include a hydraulic fluid line (not shown) for receiving hydraulic fluid. The hydraulic fluid may be used to rotate a shaft of rotary head 26 on which the drill string 28 is connected for rotating the drill string 28 (and thus rotating drill bit 30). The hydraulic fluid line of rotary head 26 may be coupled to a hydraulic valve 32 (shown schematically in FIG. 1) for controlling the amount, and flow rate, of the hydraulic fluid into rotary head 26. In the exemplary embodiment, hydraulic valve 32 may be located on the hydraulic fluid storage tank 36. However, hydraulic valve 32 may be located anywhere along the hydraulic fluid line of the rotary head 26, as necessary.

Drilling mast 16 may further include a hydraulic feed cylinder 34 (located within mast frame 24) connected to rotary head 26 via a cable and pulley system (not shown) for moving rotary head 26 up and down along the mast frame 24. As such, when hydraulic feed cylinder 34 is extended, hydraulic feed cylinder 34 may exert a force on rotary head 26 for pulling-down rotary head 26 along mast frame 24. Likewise, when hydraulic feed cylinder 34 is retracted, hydraulic feed cylinder 34 may exert a force on rotary head 26 for hoisting up rotary head 26 along mast frame 24. Thus, hydraulic feed cylinder 34 may be controllable to control rotary head 26 to move up and down the mast frame 24 such that drill bit 30 on drill string 28 may be pulled-down towards, and into, the ground surface or hoisted up from the ground surface. As used herein, the term "feed" in the context of the feed cylinder 34 includes movement of the drill string 28 in either direction (up or down). Hydraulic feed cylinder 34 may include hydraulic fluid lines (not shown) for receiving and conveying hydraulic fluid to and from the feed cylinder 34. The hydraulic fluid may be used to actuate hydraulic cylinder 34 such that a rod of hydraulic cylinder 34 may be extended or retracted. The hydraulic fluid line of hydraulic cylinder 34 may be coupled to hydraulic valves 38 (shown schematically in FIG. 1) for controlling the amount, and flow rate and pressure, of the hydraulic fluid into hydraulic cylinder 34. In the exemplary embodiment, hydraulic valve 32 may be located on the hydraulic fluid storage tank 36. However, hydraulic valve 32 may be located anywhere along the hydraulic fluid line of the hydraulic cylinder 34, as necessary. It is understood that hydraulic fluid may be any type of hydraulic fluid, such as hydraulic oil or the like.

FIG. 1 shows the drill string 28 located in hole 50. The hole 50 includes a collaring portion 52 at a top portion of the hole, and a bottom of the hole 54 (e.g., desired depth of hole). As shown by the arrows in FIG. 1, drill string 28 can rotate, and move up and down (e.g. feed and retract/hoist) such that drill bit 30 rotates and moves up and down, respectively. Further drill string 28 may include water and air lines (not shown) for supplying water and/or compressed air through the drill bit 30 to the hole 50.

Figure 2:
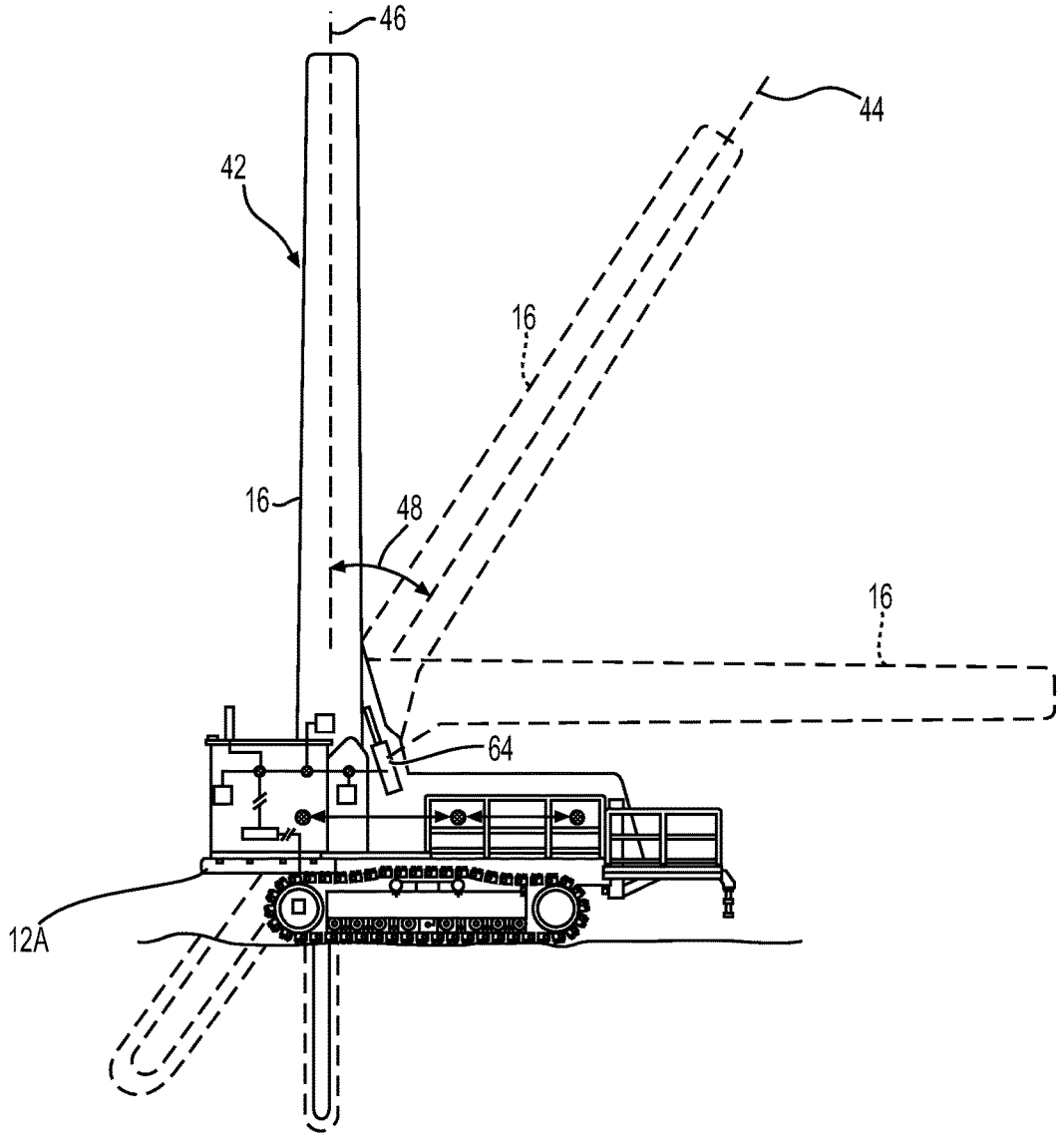
FIG. 2 is a diagrammatic illustration of an exemplary disclosed drill rig that is similar or identical to that of FIG. 1 having the ability to change the mast angle of the drill apparatus relative to the vertical direction.
Figure 3:
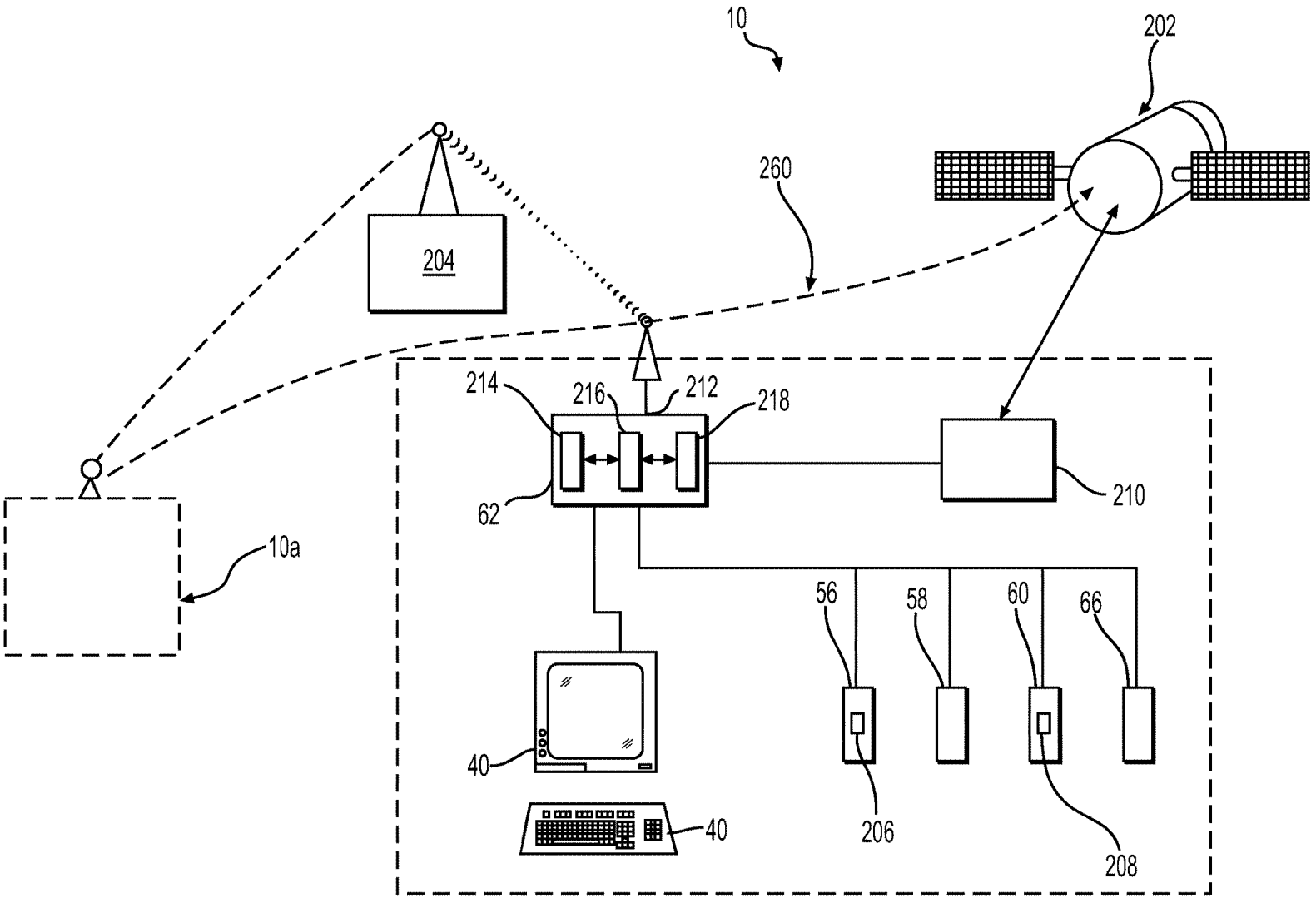
FIG. 3 is a diagrammatic illustration of an exemplary control system for use with the drill rig of FIG. 2.

Referring now to FIGS. 1 thru 3, a machine that may employ an automated hoisting speed adjustment system according to various embodiments of the present disclosure will be described. The machine 10 may comprise a frame 12, and at least two ground engaging propulsion elements (e.g. crawler tracks 18, tires, etc.) that are coupled to the frame 12 as alluded to above herein.

The machine 10 may further comprise a drilling implement 42 including a drill (e.g. a drill bit 30), and a mast (e.g. drilling mast 16), defining a longitudinal axis 44 (see FIG. 2) movable relative to the frame 12*a*, and a vertical axis 46 from a vertical position to an inclined position forming a mast angle 48 that is greater than zero degrees measured from the vertical axis 46 to the longitudinal axis 44 in a plane containing the longitudinal axis 44 and the vertical axis 46 (e.g. the plane of the view shown in FIG. 2). An actuator 64 such as an electric motor, a hydraulic cylinder, etc. that is operably coupled to the drilling implement is typically provided to raise or lower the drilling implement.

As also alluded to earlier herein, the machine 10 may also include a rotary drilling mechanism (e.g. rotary head 26) operatively coupled to the drill (e.g. the drill bit 30) as previously described herein. In addition, the machine 10 may include a first monitoring mechanism 56 (see FIG. 3) that is configured to indicate the mast angle 48, a second monitoring mechanism 58 configured to indicate a hoisting speed of the hoisting mechanism, and a third monitoring mechanism 60 configured to indicate a drill rotation speed.

Figure 4:
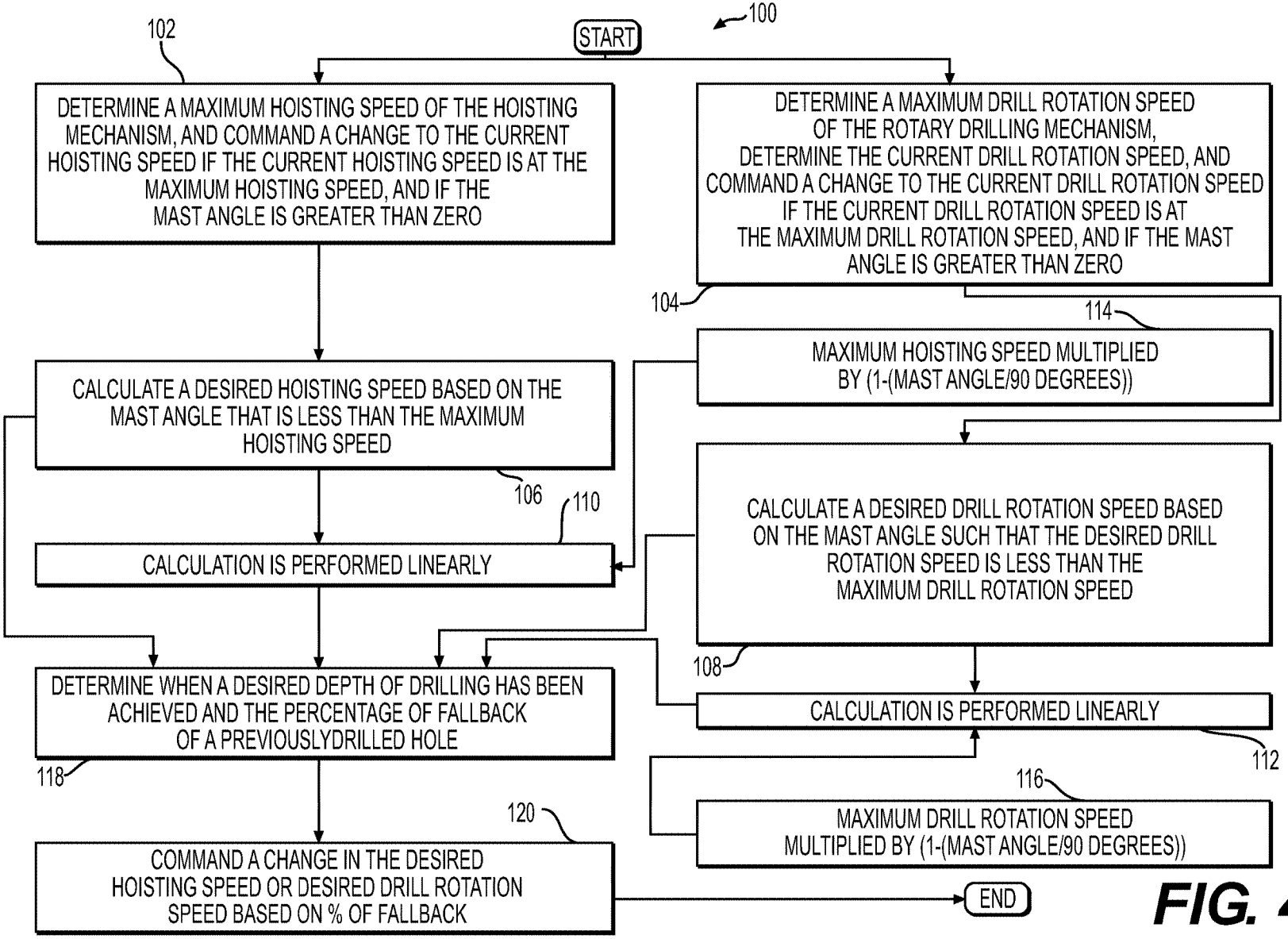
FIG. 4 is a flowchart illustrating an exemplary method for automatically adjusting hoist speed and/or drill rotation speed depending on the mast angle.

Furthermore, the machine 10 may include a control unit 62 that is coupled to the first monitoring mechanism 56, the second monitoring mechanism 58, and the third monitoring mechanism 60. The control unit 62 may be configured to execute the steps of a method 100 such as shown in FIG. 4:

determine a maximum hoisting speed of the hoisting mechanism, determine the current hoisting speed of the hoisting mechanism, and command a change to the current hoisting speed of the hoisting mechanism if the current hoisting speed is at the maximum hoisting speed, and if the mast angle is greater than zero (step 102); and/or determine a maximum drill rotation speed of the rotary drilling mechanism, determine the current drill rotation speed of the rotary drilling mechanism, and command a change to the current drill rotation speed if the current drill rotation speed is at the maximum drill rotation speed, and if the mast angle is greater than zero (step 104).

The control unit 62 may also be configured to: calculate a desired hoisting speed based on the mast angle such that the desired hoisting speed is less than the maximum hoisting speed (step 106), or calculate a desired drill rotation speed based on the mast angle such that the desired drill rotation speed is less than the maximum drill rotation speed (step 108).

The control unit 62 may be further configured to: calculate a desired minimum hoisting speed based on the mast angle, and the desired hoisting speed is calculated to be linearly proportional to the difference of the maximum hoisting speed minus the desired minimum hoisting speed (step 110), and/or calculate a desired minimum drill rotation speed based on the mast angle, and the desired drill rotation speed is calculated to be linearly proportional to the difference of the maximum drill rotation speed minus the desired minimum drill rotation speed (step 112).

For example, the minimum drill rotation speed may be determined to be zero when the mast is fully reclined at a mast angle 48 of 90 degrees, or at a mast angle of 45 degrees, etc. Or, the minimum drill rotation speed may be 5% of the maximum drill rotation speed, 10% of the maximum drill rotation speed, etc. at various mast angles. In other embodiments, an angle that is greater than zero but less than 2 degrees or 3 degrees may be used as the threshold at which modification of a drill rotation speed or a hoisting speed is warranted. Accordingly, "greater than zero" as used herein is to be interpreted broadly to cover both zero and slightly greater than zero such as 2 degrees or 3 degrees. This may take into account the various accuracies associated with measurement, equipment tolerances, etc. Some machines limit the mast angle at which angled drilling is possible at 30 degrees.

Similarly, the minimum hoisting speed maybe zero when the mast is fully reclined at a mast angle 48 of 90 degrees, or at a mast angle of 45 degrees, 30 degrees, etc. Or, the minimum hoisting speed may be 5% of the maximum hoisting speed, 10% of the maximum hoist speed, etc. at various mast angles.

The speed versus angle curve may be linear, polynomial, exponential, logarithmic, empirically tabulated, etc.

In some embodiments, the desired hoisting speed is calculated using the following equation: maximum hoisting speed multiplied by (1−(mast angle/90 degrees)), or the desired drill rotation speed is calculated using the following equation: maximum drill rotation speed multiplied by (1−(mast angle/90 degrees)). In such a case, the mast angle may reach 30 degrees, reducing the speeds by a third, etc.

In further embodiments, the desired hoisting speed may be calculated based on user inputs. The first input would be referred to as VDHS (for "vertical drilling hoisting speed") may be set at 500 mm/sec, while the second input would be referred to as ADHS (for "angle drilling hoist speed" at the maximum mast angle). If the maximum mast angle is 30 degrees, than the desired or Nominal Hoist Rate=(ADHS−VDHS)/(Max Mast Angle)*Mast Angle)+VDHS (see step 114). If the mast angle is set at 15 degrees, then the Nominal Hoist Rate=(250 mm/s−500 mm/s)/(30 degrees), which equals −8 mm/(s*degree). Then, −8 mm/(s*degree) would be multiplied by 15 degrees, which equals −125 mm/s. Adding 500 mm/s, yields a desired or Nominal Hoist Rate of 375 mm/s. The desired or nominal drill rotation speed may be calculated the same way except VDHS would be substituted with the desired maximum drill rotation speed, while the ADHS would be substituted with the minimum drill rotation speed at the maximum mast angle, etc.

The machine may also comprising a measurement unit 66 (see FIG. 3, could be measured using a laser, radar, acoustics, track the number of sections of drill pipe, the position of the drill bit, etc.) that is configured to determine a depth of drilling of the drill. The control unit may be configured to determine when a desired depth of drilling has been achieved and the percentage of fallback based on the fallback of a previously drilled hole (step 118) (e.g. under similar or identical conditions and parameters). In such a case, the control unit 66 may also be configured to command a change in the desired hoisting speed or a change in the desired drill rotation speed based on the percentage of fallback of the previously drilled hole (step 120).

For example, it may be determined that the fallback of a previously drilled hole was 5% while a 10% level of fallback is acceptable. Then, the next similarly drilled hole may have an increase in the hoisting speed and/or drill rotation speed in an effort to maximize efficiency. This may be done using an offset that is inputted into the control unit either manually or automatically, etc. In other cases, a decrease in these parameters may be warranted to avoid exceeding a suitable amount of fallback.

Any of the variables or parameters discussed herein may be stored in the memory of the control unit, may be manually inputted, may be received from a source outside of the machine, calculated, etc. Maximum speeds may be determined based on equipment limitations, drill and ground material interface dynamics, ground material properties, etc. Similarly, minimum speeds may be set manually or be preprogrammed in order to prevent too much of a reduction in production, etc.

Communication may be provided between the machine 10 and another machine 10*a* via Wi-Fi, Bluetooth, satellite 202, radio waves, communication with a base station 204 etc. (see FIG. 3) regarding the amount of fallback, and other operating parameters.

With continued reference to FIG. 3, an automatic hoist speed adjustment system 200 that may be used by the machine 10 just described may be characterized as follows.

The system 200 may comprise a first monitoring mechanism 56 that is configured to indicate a mast angle of a drilling implement including a drill and a mast, a second monitoring mechanism 58 that is configured to indicate a hoisting speed of a hoisting mechanism, and a third monitoring mechanism 60 that is configured to indicate a drill rotation speed of the drill.

The first monitoring mechanism 56 may include a position sensor 206 that is configured to monitor the mast angle relative to a vertical axis. The position sensor 202 may include one of the following: a linear position sensor, a rotary potentiometer, and a camera, etc.

The third monitoring mechanism may be a sensor (e.g., a speed sensor 208) that may be configured to detect a rotation speed of the drill bit 30. Rotation speed input may communicate a rotation speed signal indicative of a rotation speed of the drill bit 30 to control unit 62. For example, rotation speed input may monitor the rotation speed of the rotary head 26 (see also FIG. 1). Rotation speed input may embody a conventional rotational speed detector having a stationary element rigidly connect to the rotary head 26 that is configured to sense a relative rotational movement of the rotary head 26 (e.g., of a rotational portion of the rotary head 26 that is operatively connected to the rotary head 26, such as a shaft of the rotary head 26 or the drill string 28 mounted on the rotary head 26). The stationary element may be a magnetic or optical element mounted to a housing of the rotary head assembly and configured to detect rotation of an indexing element (e.g., a toothed tone wheel, an embedded magnet, a calibration stripe, teeth of a timing gear, etc.) connected to rotate with the shaft of the rotary head 26. A sensor of rotation speed input may be located adjacent the indexing element and configured to generate a signal each time the indexing element (or a portion thereof) passes near the stationary element. The signal may be directed to the control unit 62, which may use the signal to determine a number of shaft rotations of the rotary head 26, occurring within fixed time intervals, and use this information to determine the rotation speed value.

The second monitoring mechanism may include a sensor that measures the rotation of a rotating element of the hoisting mechanism and may take similar forms and work in like manner as the third monitoring mechanism.

Figure 5:
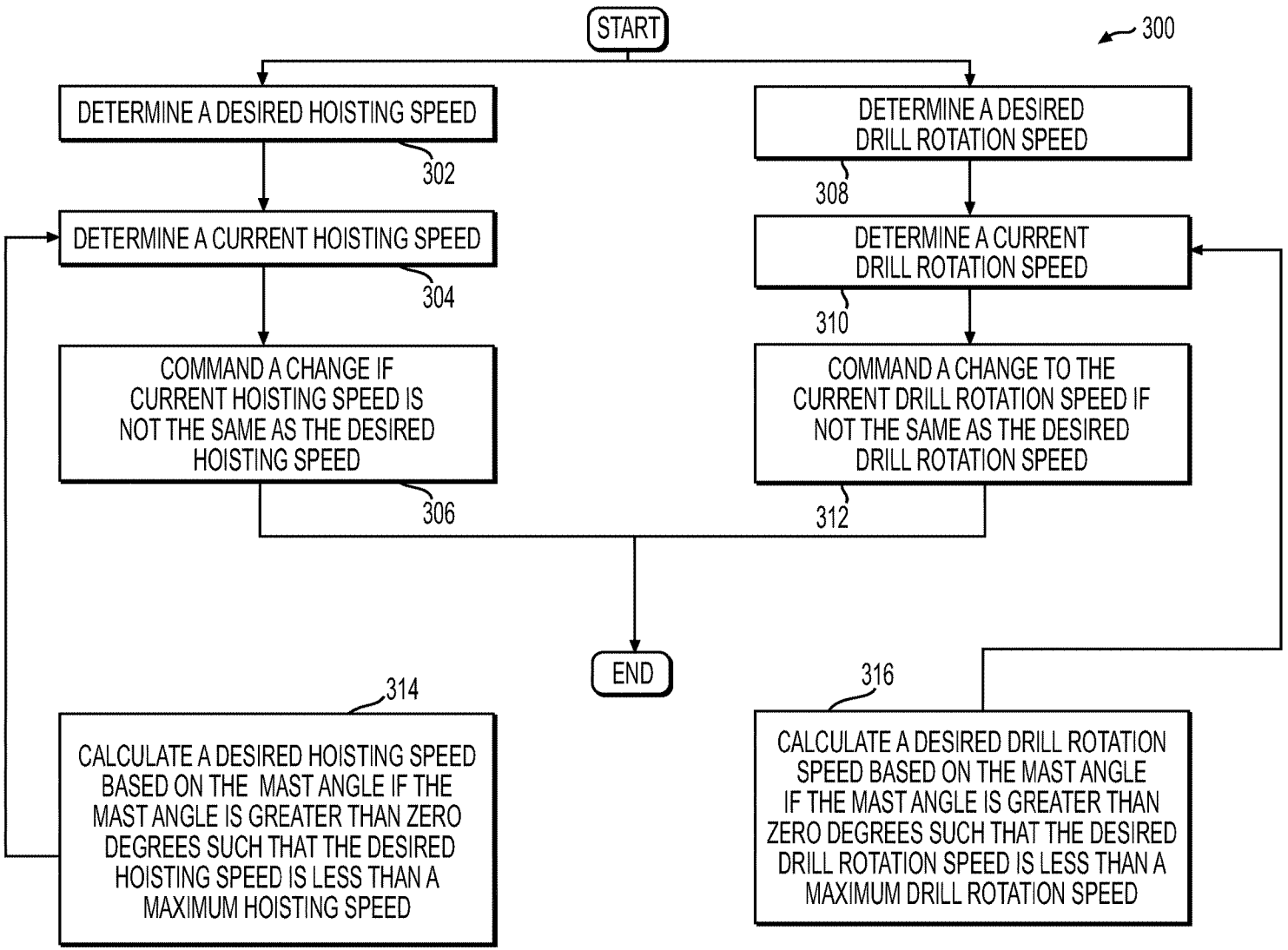
FIG. 5 is a flowchart illustrating another embodiment of a method for automatically adjusting hoist speed and/or drill rotation speed depending on the mast angle.

The control unit 62 (e.g. an electronic controller unit) may be coupled to the first monitoring mechanism 56, the second monitoring mechanism 58, and the third monitoring mechanism 60. The electronic controller unit may be structured to perform the following steps of method 300 as shown in FIG. 5: determine a desired hoisting speed (step 302), determine a current hoisting speed (step 304), and command a change to the current hoisting speed if the current hoisting speed is not the same as the desired hoisting speed (step 306), and/or determine a desired drill rotation speed (step 308), determine a current drill rotation speed (step 310), and command a change to the current drill rotation speed if the current drill rotation speed is not the same as the desired drill rotation speed (step 312).

For example, determining the desired hoisting speed or the desired drill rotation speed may involve performing experiments to see what percentage of fallback is acceptable, and what drill rotation speed and/or what hoisting speed achieve the acceptable amount of fallback at various mast angles. In other cases, the desired hoisting speed, and the desired drill rotation speed may involve using tables or equations, etc.

The electronic controller unit may also be configured to calculate a desired hoisting speed based on the mast angle if the mast angle is greater than zero degrees such that the desired hoisting speed is less than a maximum hoisting speed (step 314), and/or the electronic control unit may be configured to calculate a desired drill rotation speed based on the mast angle if the mast angle is greater than zero degrees such that the desired drill rotation speed is less than a maximum drill rotation speed (step 316). This may not be the case for other embodiments of the present disclosure. For example, the maximum speeds may be acceptable until the mast angle reaches 5 degrees or more, etc.

In various embodiments of the present disclosure, levers, knobs, dials, GUIs (graphical user interfaces), and HMIs (human machine interfaces), etc. may be examples of input devices while displays, lights, and alarms may be examples of output devices.

In various embodiments of the present disclosure, the machine 10 may include other components such as transmission systems, engine(s), motors, power system(s), hydraulic system(s), suspension systems, cooling systems, fuel systems, exhaust systems, anchor systems, propelling systems, communication systems including antennas, Global Positioning Systems (GPS, see 210 in FIG. 3), and the like (not shown) that are coupled to the control unit 62.

Looking again at FIG. 3, the control unit 62 may take any suitable form including a suitable combination of hardware and software. For the embodiment explicitly shown in FIG. 3, the control unit 62 (e.g. an electronic controller unit) includes the input-output port 212, a processor 214, and the memory 216 coupled to each other, for example, by an internal bus (not shown). The electronic controller unit may include additional components known to one of ordinary skill in the art, which components are not explicitly illustrated in FIG. 3. For example, the electronic controller unit may include a programmable logic circuit (PLC), a timer/clocking circuit, heat sinks, visual indicators (e.g., light emitting diodes), impedance matching circuitry, internal buses, co-processors or monitor processors, batteries and power supply units, power controller chips, transceivers, wireless modules, satellite communication processing modules, and embedded systems on various integrated chips. In one embodiment, the electronic controller unit may be separate from an engine controller unit (not shown). In an alternative embodiment, the electronic controller unit may be integrated with or may share space and processing resources with the engine controller unit.

The input-output port 212 may be a single port or a collection of ports. The input-output port 212 may be configured to transmit and receive various inputs and data from other parts of the machine 10 and forward such inputs and data to the processor 214. In one aspect, the input-output port 212 may be two separate ports, one configured to receive various input signals from various parts of the machine 10 (e.g., the sensor(s), etc.) and another configured to output signals for display (e.g., see display 40 in FIG. 3) or for control of the machine 10 (e.g., to the machine control system). Alternatively, the functionalities of inputting and outputting may be integrated into a single port illustrated as the input-output port.

In one aspect, the processor 214 is a hardware device such as an integrated circuit (IC) chip fabricated to implement various features and functionalities of the embodiments discussed herein. By way of example only and not by way of limitation, the processor 214 may be fabricated using a Complementary Metal Oxide Semiconductor (CMOS) fabrication technology. In one embodiment, the processor 506 may be implemented as an Application Specific Integrated Circuit (ASIC), a Field Programmable Gate Array (FPGA), a System-on-a-Chip (SOC), or the like. In another embodiment, the processor 214 may include components such as packaging, input and output pins, heat sinks, signal conditioning circuitry, input devices, output devices, processor memory components, cooling systems, power systems and the like, which are not shown in FIG. 3. In one particular embodiment, the processor 214 is configured to execute various parts of a method 100, 300, and 400 illustrated in FIGS. 4 thru 6 by executing computer executable instructions 218 in the memory 216. In yet another embodiment, the processor 214 may be a plurality of processors arranged, for example, as a processing array.

The memory 216 may be implemented as a non-transitory computer readable medium. By way of example only, the memory 216 may be a semiconductor based memory device including but not limited to random access memory (RAM), read only memory (ROM), Dynamic RAM, Programmable ROM, Electrically Erasable programmable ROM (EEPROM), Static RAM, Flash memory, combinations thereof, or other types of memory devices known to one of ordinary skill in the art. In one embodiment, the memory 216 is coupled to the processor 214 directly via a communication and signal bus. In one embodiment, the memory 216 may be made of or implemented using a non-transitory computer readable storage medium on which the computer executable instructions 218 reside. The computer executable instructions 218 when executed by the processor 214 cause the processor 214 to carry out the features and functionalities of the various aspects of this disclosure. Such non-transitory computer readable storage medium may include semiconductor memory, optical memory, magnetic memory, mono- or bistable circuitry (flip-flops, etc.) and the like, or combinations thereof. Such non-transitory computer readable storage medium excludes signals that are transitory.

INDUSTRIAL APPLICABILITY

In practice, a machine, an automatic speed adjustment system, an electronic controller unit, or a method according to any embodiment described, shown or discussed herein may be sold, bought, manufactured, remanufactured, retrofitted, assembled or otherwise obtained in an aftermarket or OEM (original equipment manufacturer) context. Similarly, a machine using such an automatic speed adjustment system, an electronic controller unit or a method according to any embodiment described herein may be provided when the machine is new or when the machine is retrofitted with any of these embodiments.

Figure 6:
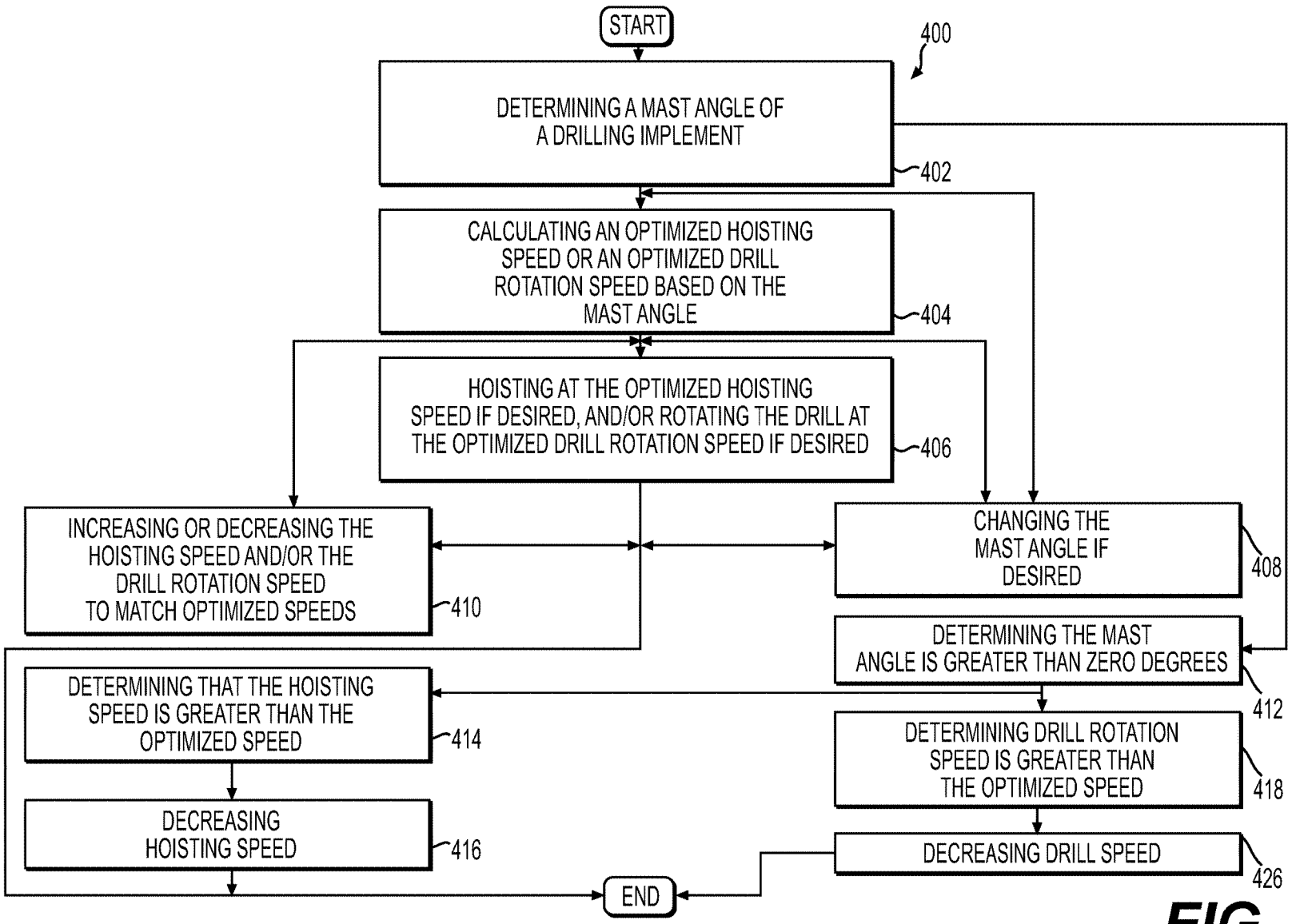
FIG. 6 is a flowchart illustrating yet another embodiment of a method for automatically adjusting hoist speed and/or drill rotation speed depending on the mast angle.

FIG. 6 discloses a method 400 that may be implemented by any of the apparatus described herein. The method 400 may comprise determining a mast angle of a drilling implement (step 402), calculating the optimized hoisting speed for a drilling implement based on the mast angle or calculating the optimized drill rotation speed based on the mast angle (step 404), and hoisting the drilling implement at the optimized hoisting speed if desired, and/or rotating the drill at the optimized drill rotation speed if desired (step 406). In some cases, the optimized speed may be outside of the limitations of the equipment and cannot be performed or productivity may be lowered too much. If so, the operator or system may change the mast angle instead as needed (step 408).

The method 400 may further comprise increasing or decreasing the hoisting speed to match the optimized hoisting speed, and/or increasing or decreasing the drill rotation speed to match the optimized drill rotation speed (step 410).

In some cases, the method 400 may include determining that the mast angle is greater than zero degrees (step 412), determining that the hoisting speed is greater than the optimized hoisting speed (step 414), and decreasing the hoisting speed until the optimized hoisting speed is reached (step 416), and/or determining that the drill rotation speed is greater than the optimized drill rotation speed (step 418), and decreasing the drill rotation speed until the optimized drill rotation speed is reached (step 420).

In other cases, it may be determined that the mast angle is zero, and that hoisting the drilling implement at a maximum hoisting speed and rotating the drill at a maximum drill rotation speed is desired (step 422).

The method 400 may further comprise determining the acceptable amount of fallback, measuring or predicting the actual amount of fallback, and adjusting the hoisting speed or the drill rotation speed such that the acceptable amount of fallback is maintained (step 424).

The method may take other variables into account. For example, the speeds and mast angle may be adjusted depending on the ground material properties. Also, the hoisting speed may be adjusted based on the drill rotation speed, or vice versa, etc.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A machine comprising:

a frame;

at least two ground engaging propulsion elements coupled to the frame;

a drilling implement including a drill and a mast, defining a longitudinal axis movable relative to the frame and a vertical axis from a vertical position to an inclined position forming a mast angle that is greater than zero degrees measured from the vertical axis to the longitudinal axis in a plane containing the longitudinal axis and the vertical axis;

a rotary drilling mechanism operatively coupled to the drill;

a first monitor configured to indicate the mast angle;

a second monitor configured to indicate a hoisting speed of a hoisting mechanism;

a third monitor configured to indicate a drill rotation speed;

a controller coupled to the first monitor, the second monitor, and the third monitor, wherein the controller is configured to:

determine a maximum hoisting speed of the hoisting mechanism, determine a current hoisting speed of the hoisting mechanism, and command a change to the current hoisting speed of the hoisting mechanism if the current hoisting speed is at the maximum hoisting speed, and if the mast angle is greater than zero; or determine a maximum drill rotation speed of the rotary drilling mechanism, determine the current drill rotation speed of the rotary drilling mechanism, and command a change to the current drill rotation speed if the current drill rotation speed is at the maximum drill rotation speed, and if the mast angle is greater than zero; and an actuator that is operably coupled to the drilling implement to raise or lower the drilling implement, wherein the commanding the change to the current drill rotation speed or the commanding the change to the current hoisting speed occurs only if the mast angle is greater than two degrees.

2. The machine of claim 1, wherein the controller is configured to:

calculate a desired hoisting speed based on the mast angle such that the desired hoisting speed is less than the maximum hoisting speed, or calculate a desired drill rotation speed based on the mast angle such that the desired drill rotation speed is less than the maximum drill rotation speed.

3. The machine of claim 2, wherein the controller is configured to:

calculate a desired minimum hoisting speed based on the mast angle, and the desired hoisting speed is calculated to be linearly proportional to a difference of the maximum hoisting speed minus the desired minimum hoisting speed; or calculate a desired minimum drill rotation speed based on the mast angle, and the desired drill rotation speed is calculated to be linearly proportional to the difference of the maximum drill rotation speed minus the desired minimum drill rotation speed.

4. The machine of claim 3, wherein the desired hoisting speed is calculated using the following equation: Nominal Hoist Rate=(ADHS−VDHS)/((Max Mast Angle)*Mast Angle)+VDHS.

5. The machine of claim 4, further comprising a measurement circuitry that is configured to determine a depth of drilling of the drill.

6. The machine of claim 5, wherein the controller is configured to determine when a desired depth of drilling has been achieved and a percentage of fallback of a previously drilled hole.

7. The machine of claim 6, wherein the controller is configured to command a change in the desired hoisting speed or a change in the desired drill rotation speed based on the percentage of fallback of the previously drilled hole.

8. The machine of claim 1, wherein at least two ground engaging propulsion elements coupled to the frame include at least two crawler tracks.

9. An automatic hoist speed adjustment system comprising:

a first monitor configured to indicate a mast angle of a drilling implement including a drill and a mast;

a second monitor configured to indicate a hoisting speed of a hoisting mechanism;

a third monitor configured to indicate a drill rotation speed of the drill; and an electronic controller coupled to the first monitor, the second monitor, and the third monitor, wherein the electronic controller is structured to:

determine a desired hoisting speed, determine a current hoisting speed, and command a change to the current hoisting speed if the current hoisting speed is not the same as the desired hoisting speed; or determine a desired drill rotation speed, determine a current drill rotation speed, command a change to the current drill rotation speed if the current drill rotation speed is not the same as the desired drill rotation speed, and determine an acceptable amount of fallback, measuring or predicting an actual amount of fallback, and adjusting the hoisting speed or the drill rotation speed such that the acceptable amount of fallback is maintained.

10. The automatic hoist speed adjustment system of claim 9, wherein the first monitor includes a position sensor configured to monitor the mast angle relative to a vertical axis.

11. The automatic hoist speed adjustment system of claim 10, wherein the position sensor includes one of the following: a linear position sensor, a rotary potentiometer, and a camera.

12. The automatic hoist speed adjustment system of claim 9, wherein the second monitor includes a sensor that measures rotation of a rotating element of the hoisting mechanism.

13. The automatic hoist speed adjustment system of claim 9, wherein the electronic controller is configured to calculate a desired hoisting speed based on the mast angle if the mast angle is greater than zero degrees such that the desired hoisting speed is less than a maximum hoisting speed, or the electronic controller is configured to calculate a desired drill rotation speed based on the mast angle if the mast angle is greater than zero degrees such that desired drill rotation speed is less than a maximum drill rotation speed.

14. A method comprising:

determining a mast angle of a drilling implement having a drill;

calculating an optimized hoisting speed for the drilling implement based on the mast angle or calculating an optimized drill rotation speed based on the mast angle;

hoisting the drilling implement at the optimized hoisting speed, or rotating the drill at the optimized drill rotation speed; and determining an acceptable amount of fallback, measuring or predicting an actual amount of fallback, and adjusting the hoisting speed or the drill rotation speed such that the acceptable amount of fallback is maintained.

15. The method of claim 14, further comprising increasing or decreasing the hoisting speed to match the optimized hoisting speed, or increasing or decreasing the drill rotation speed to match the optimized drill rotation speed.

16. The method of claim of claim 15, further comprising determining that the mast angle is greater than zero degrees, determining that the hoisting speed is greater than the optimized hoisting speed, and decreasing the hoisting speed until the optimized hoisting speed is reached, or determining that the drill rotation speed is greater than the optimized drill rotation speed, and decreasing the drill rotation speed until the optimized drill rotation speed is reached.

17. The method of claim 14, further comprising determining that the mast angle is zero, and hoisting the drilling implement at a maximum hoisting speed and rotating the drill at a maximum drill rotation speed.

18. The method of claim 14, further comprising changing the mast angle if needed.

* * * * *